United States Patent [19]

Olson et al.

[11] 4,010,066

[45] Mar. 1, 1977

[54] METHOD FOR IMPROVING HEAT ECONOMY IN THE BATCHWISE DIGESTION OF LIGNOCELLULOSIC MATERIAL BY ADJUSTING THE LEVEL OF FREE DIGESTION LIQUOR

[75] Inventors: Ulf Torbjorn Olson, Moliden; Erik Olof Sture Hagglund, Ornskoldsvik, both of Sweden

[73] Assignee: Mo och Domsjo, Ornskoldsvik, Sweden

[22] Filed: Oct. 17, 1974

[21] Appl. No.: 515,736

[30] Foreign Application Priority Data

Oct. 17, 1973 Sweden ..... 7314127

[52] U.S. Cl. ..... 162/49; 162/61

[51] Int. Cl.[2] ..... D21C 7/12

[58] Field of Search ..... 162/61, 17, 19, 52, 162/49, 238, 246, 198, 248, 63, 68

[56] References Cited

UNITED STATES PATENTS

| | | | |
|---|---|---|---|
| 2,909,239 | 1/1956 | Bennett | 162/238 X |
| 3,159,527 | 12/1964 | Helland | 162/61 |
| 3,210,237 | 10/1965 | Madison | 162/61 |
| 3,215,588 | 11/1965 | Kleinert | 162/19 |
| 3,764,464 | 10/1973 | Samuelson | 162/65 |
| 3,785,920 | 1/1974 | Vohansen | 162/246 X |

OTHER PUBLICATIONS

"Autocook System Brings Full Automation to Batch Digesters," MacLeod Paper Trade Journal; Aug. 16, 1971.

*Pulping Processes*, Rhydholm, pp. 334–335, Interscience Publishers, New York, 1965.

*Primary Examiner*—Robert L. Lindsay, Jr.
*Assistant Examiner*—Steve Alvo

[57] ABSTRACT

A method for improving heat economy in the batchwise digestion of lignocellulosic material especially when using a batch digester with a digestion or cooking liquor in which the digestion or cooking chemicals are dissolved, such as in sulphate, sulphite, bisulphite, oxygen, peroxide and ammonium hydroxide digestion processes, and also in the manufacture of high yield semichemical pulps.

A superatmospheric gas pressure is applied above the level of the liquor in a batch digester; the level of the digester liquor is determined after the liquor has been absorbed by a batch lignocellulosic material; the level of free digestion liquor is then adjusted to that level providing an amount including the absorbed liquor to digest the lignocellulosic material; and then the material is digested under the superatmospheric pressure to form cellulose pulp.

8 Claims, No Drawings

METHOD FOR IMPROVING HEAT ECONOMY IN THE BATCHWISE DIGESTION OF LIGNOCELLULOSIC MATERIAL BY ADJUSTING THE LEVEL OF FREE DIGESTION LIQUOR

The term "batch digester" as used herein refers to a digester which consists essentially of a pressure vessel (the digester); means for charging chips of lignocellulosic material and digestion or cooking liquor to the digester; means for heating the digester to the digestion temperature; and means for emptying (blowing) the digester when the digestion is halted or completed.

The digester can be heated in two ways; i.e. by:

a. Indirect heating, in which the digestion or cooking liquor is heated by circulation through a steam-heated heat exchanger located externally of the digester, and returned to the digester. The digestion liquor is removed from the digester via a ring of strainer plates mounted in the lower half of the digester, and is returned to the digester via an inlet arranged in the top of said digester, and normally also in the bottom thereof. The digester or cooking liquor is circulated between the heater and the digester by a circulation pump.

b. Direct heating, in which steam is injected directly in the digester, and is condensed therein. The steam inlet is mounted in the bottom of the digester.

The level of liquid in the digester during a digestion or cook is important to the economy of the process. The level of digestion liquor in an indirectly heated digester must lie well above the strainer plates during the whole of a digestion, since otherwise the circulation of digestion or cooking liquid is poor, resulting in uneven cooking of the chips. In order to empty (blow) the pulp from the digester at the end of the digestion, a certain quantity of digestion liquor is required, since otherwise the blowing lines become blocked. To minimize the costs of heating the digester, it is desirable to effect the digestion with the smallest possible quantity of digestion liquor, since otherwise unnecessarily large amounts of heat are used to heat the recirculating digestion liquor. It is also an advantage to use the same amount of digestion liquor from cook to cook, since otherwise different reaction speeds are obtained, according to the dilution of the liquor, which renders control of the digestion more difficult.

The moisture content of the wood charged to the digester varies from batch to batch and from plant to plant. This also leads to variations in the digestion. Attempts have been made to compensate for the varying liquid contents of the chips. These attempts have taken two forms:

a. The chips have been treated with steam to bring the moisture content of the chips to a predetermined level. A long time is needed for the chips to reach moisture equilibrium, however, and the process requires a large quantity of steam.

b. The chips have been weighed and their moisture content measured, after which it is calculated roughly how must digestion liquor needs to be charged together with the wood, so that variations in the moisture content of said wood can be compensated for, by adjusting the amount of digestion liquor charged to the digester. Moisture content measurements are extremely difficult to carry out accurately, however, and the necessary measuring equipment is expensive, and requires extensive maintenance. Furthermore, the measurements are very unreliable.

In accordance with the present invention, a method is provided for the batchwise digestion of lignocellulosic material with improved heat economy, using a digestion liquor in which the digestion chemicals are in solution in the liquor, comprising subjecting the lignocellulosic material in particulate form while immersed in digestion liquor to a superatmospheric pressure, preferably within the range from about 1 to about 15 bars, still more preferably within the range from about 1.5 to about 8 bars, above atmospheric pressure, for a time sufficient to bring the digestion liquor content of the particulate material to an equilibrium level for the pressure used; determining the amount of digestion liquor absorbed, and adjusting the amount of digestion liquor to an amount sufficient to digest the lignocellulosic material; and then digesting the material to form cellulose pulp.

The method of the present invention is of particular application to the digestion of lignocellulosic material in a batch digester as described above, in which lignocellulosic material and cooking liquor are charged to a predetermined level in the digester, after which the digester is heated to elevated temperature and elevated pressure. If particulate lignocellulosic material and digestion liquor are charged to a pressure vessel, and a superatmospheric pressure is created in said vessel, the digestion liquor enters the material so rapidly that the voids in the particles are at least substantially filled with digestion liquor after a relatively short time. Since the voids of moist particles contain more liquid than dry particles, a moist particle will absorb less digestion liquor than a dry particle. Practical tests have shown that the particles reach an equilibrium digestion liquor content according to the pressure applied after only a few minutes of pressure treatment. Thus, application of pressure can cause the pieces to reach a relatively constant amount of liquor in relation to their dry weight.

By application of the process of the invention, the digestion liquor content of the particulate lignocellulosic material is increased from about 10% to about 70%, usually from about 40% to about 60%. Prior to the treatment of the invention, the water content may range from about 10% to about 60%; this water content may be increased, or its content of digestion chemicals increased, in the treatment.

Following the pressure treatment, the amount of digestion liquor is adjusted, by either adding or removing liquor, to compensate for the digestion liquor absorbed by the lignocellulosic material. The amount of digestion liquor after adjustment should not appreciably exceed that required for the digestion of the batch of lignocellulosic material. The minimum amount of digestion liquor for the digestion is preferred, but this of course is not determinable with exact precision because of the nature of the digestion process. Also, the digester design plays an important part in determining the minimum amount physically required for the digestion (chemical criteria are not entirely determinative, either.)

The amount of liquor necessary to obtain a satisfactory course of digestion is prescribed by two factors relating to the design of the digester used:

1. The height of the ring of strainer plates (screens) above the bottom. The digestion liquor must be above this ring during the whole cook.

2. In order to blow (empty) the digester a certain amount of liquor also is needed. If the strainers are placed very low in the digester (about one fifth of the height of the digester) a level of digestion liquor corresponding to the level of the strainers will not be enough to blow the digester. If on the other hand the strainers are placed very high in the digester (about half the height of the digester) a level of cooking liquor above the level of the strainers will be enough to blow the digester.

The necessary amount of liquor also depends on the species of wood used so that it is necessary to use more liquor to blow birch chips than to blow pine chips.

Thus, the requirement is to some extent determined by experience according to operation of each digester.

According to the process of the invention, when applied to a batch digester, the liquid level of the pressure vessel is measured before and after the pressure treatment step, and according to the difference in liquid level, the level of digestion liquor is adjusted to a level suitable for each digestion. The difference in liquid level before and after the pressure treatment step makes it possible to establish how much liquor has been absorbed by the particulate lignocellulosic material, and from this one can determine how much digestion liquor is needed in order to digest in a satisfactory manner the lignocellulosic material present in the digester. It is possible either to charge liquor to the digester or to remove liquor therefrom, so that the quantity of digestion liquor present in the digester at the beginning of a cooking operation can correspond to that theoretically desirable. One may thus regulate the quantity of free digestion liquor in the vessel so that as much recirculated digestion liquor as possible can be introduced without upsetting the digestion. In contrast prior digestion processes in order to avoid an insufficient digestion of the lignocellulosic material use a surplus of digestion liquor, regardless of the moisture content of the material. When the particles being digested are saturated with moisture this means that unnecessary costs are incurred for heating and recirculating large quantities of digestion liquor not required for the digestion.

The pressure treatment process according to this invention is suitably effected at a pressure such that the digestion liquor penetrates the particulate lignocellulosic material as quickly as possible and at least so rapidly that the liquor content thereof can be brought substantially to equilibrium at the pressure used. The particular equilibrium liquor content of the particles at a given superatmospheric pressure will of course vary with the average size and species of the particles, the type and concentration of the digestion liquor, the treatment time, and the temperature used, so that no numerical limits can be given.

The treatment time required to reach an equilibrium liquor content depends upon the pressure used; a high pressure affords a shorter treatment time, and vice versa. It has been found that in general a suitable superatmospheric pressure is within the range from about 1 to about 15 bars, although still higher pressures, up to 50 bars and more, can be applied to advantage, for example in oxygen-gas digestion processes. Normally, a superatmospheric pressure from about 1.5 to about 8 bars above atmospheric pressure is the preferred range, for most digestion processes.

The superatmospheric pressure treatment step according to the invention can be effected in practice by introducing steam directly into the digester, suitably at the top thereof, subsequent to charging digestion liquor to the wood mass of particulate lignocellulose material in the digester. The superatmospheric pressure is maintained for a period of time such that the liquor content of the particles reaches equilibrium. The level of digestion liquor is then measured, and the amount of digestion liquor adjusted to the desired value, after which the digestion is commenced.

It is not necessary that all the chips be immersed in digestion liquor during the pressure treatment, but at least about 50% of the particles should be. It is usual that the digestion liquor be charged to approximately half the height of the column of particulate material. Only the particles immersed in digestion liquor are impregnated by the digestion liquor during the pressure treatment.

The pressure treatment process of the present invention can be combined to advantage with the heating of the digestion liquor to the elevated digestion temperature. This can be done, for example, by circulating the digestion liquor through a heat exchanger located externally of the digester, by means of a circulation pump, the liquor being heated in the heat exchanger. The heated liquor is then circulated over the particulate material at the top of the digester, and percolates thence through the mass, so that the whole of the pile located in the digester is at least wetted by digestion liquor. The heating is suitably continued until a superatmospheric pressure is obtained corresponding to the temperature of the digestion liquor. Optionally, an external superatmospheric pressure can be applied at the same time. After the pressure treatment, the circulation pump is stopped, and the amount of digestion liquor is measured. The amount of digestion liquor is supplemented on the basis of the measured value, to compensate for the liquor absorbed by the particulate lignocellulosic material, and replenish the digestion liquor at least to the minimum amount required for the digestion. A suitable way is to maintain the level of liquor in the digester at a value corresponding to the desired amount of digestion liquor. The digestion is then commenced, and can be carried out in conventional manner.

Among other things, this method affords the advantage that an equilibrium liquor content is reached more rapidly at higher temperatures than at lower temperatures, and the pressure treatment time also is utilized for heating purposes at the same time.

Heating during the pressure treatment step may suitably be at a temperature of within the range from about 50° to about 165° C, preferably from 100° to 165° C. A suitable pressure treatment time is from about 3 to about 70 minutes but even shorter times may suffice in some cases. In most cases, a treatment time of from 5 to 40 minutes is particularly suitable, according to the construction of the digester, and the other steps in the cooking process.

In those cases when only a pressure treatment is combined with the heating to digestion temperature, it may be advantageous to further shorten the treatment time. For example, when there is used a bath sulphate digester, in which the cooking liquor is recirculated for heating during the pressure treatment, a treatment time of from 30 to 40 minutes is suitable, during which the digestion liquor is heated at from 120° to 140° C, and a superatmospheric pressure of from 2 to 4 bars is reached at the end of the heating.

In applying the method of the present invention, a constant amount of digestion liquor can be charged to the digester prior to the pressure treatment so that subsequent to the pressure treatment excess digestion liquor is always tapped off when adjusting the level of digestion liquor. It is also advantageous to select a constant charge of digestion liquor that is always slightly less than required to effect the digestion. Then, it is always necessary after the pressure treatment to add a certain amount of digestion liquor, preferably in the form of a recirculated black liquor. In this way, when the pressure treatment is effected simultaneously with the heating of the digestion liquor, one avoids heating a quantity of digestion liquor which is subsequently removed from the system.

The process of the invention is applicable to any kind of lignocellulosic material, such as cellulosic materials and bagasse, and especially wood. Exemplary hardwoods include birch, beech, poplar, cheery, sycamore, hickory, ash, oak, chestnut, aspen, maple, alder, and eucalyptus. Exemplary softwoods include spruce, fir, pine, cedar, juniper, and hemlock.

The lignocellulosic material should be in particulate form. Wood chips having dimensions that are conventionally employed in the sulphate process can be used.

The height of the liquor column was measured immediately after charging the liquor to the digester. The height of the liquor column was maintained at approximately half the height of the column of chips (approximately 30 cm) so as to correspond to normal plant conditions.

In one series of runs, the digestion liquor was kept in the digester for a period of time at atmospheric pressure, after which the level of the liquor was measured.

In another series of runs, nitrogen was charged to the digester until a superatmospheric pressure of 3 bars was reached. This pressure was maintained for 5 minutes, after which the level of liquor was measured, and the pressure lowered to atmospheric pressure.

In both series, the free digestion liquor was run out through the bottom of the digester, and the quantity of liquor drained was measured. In this way, the quantity of liquor absorbed by the column of chips during the tests was determined, and from this the liquid/wood ratio, after the pressure treatment of the invention.

The results obtained are shown in Table I below, for chips having a 90% and 50% dry content.

Table I

| Run No. | Chips dry content (%) | Quantity of chips charged (grams) | Height of chip column (cm) | Height of liquor column subsequent to charging (cm) | Quantity of liquor charged (liters) | Superatmospheric pressure (bars) | Time (Hours) | Height of liquor column after treatment (cm) | Quantity of liquor drained (liters)- | Quantity of liquor absorbed (liters) | Liquor wood ratio |
|---|---|---|---|---|---|---|---|---|---|---|---|
| 1 | 90 | 4000 | 60 | 35 | 13.6 | 3 | | 25 | 10.4 | 3.2 | 1.7 |
| 2 | 50 | 4000 | 65 | 36 | 13.6 | 3 | | 31 | 12.4 | 1.2 | 1.6 |
| 3 | 90 | 4000 | 60 | 35 | 13.6 | — | 1 | 31.1 | 12.3 | 1.3 | 0.7 |
| 4 | 50 | 4000 | 65 | 36 | 13.6 | — | 1 | 35.0 | 13.3 | 0.3 | 1.1 |

Appreciable advantages with respect to uniformity of the digestion process under all kinds of reaction conditions can be obtained if the wood is in the form of nonuniform fragments of the type of wood shavings or chips having an average thickness of at most 3 mm., and preferably within the range from about 0.2 to about 2 mm. Other dimensions are not critical. Sawdust, wood flour, wood slivers and splinters, wood granules, and wood chunks, and other types of wood fragments can also be used.

After the digestion process has been completed, the wood may optionally be subjected to a mechanical treatment in order to liberate the fibers. If the pulping is brief or moderate, a defibrator, disintegrator, or shredder may be appropriate. After an extensive or more complete pulping or digestion, the wood can be defibrated in the same manner as in other conventional cellulose cooking processes, such as sulfate pulping, by blowing off the material from the digester, or by pumping.

The invention is illustrated by means of Examples showing the application of the method in a batch sulphate digestion process. The method can be applied equally as well, however, with other batchwise cooking processes

EXAMPLE 1

In a series of runs, pine chips of different solids content were charged to a 25 liter laboratory digester, together with 13.6 liters of aqueous NaOH solution containing 135 g NaOH per liter. In each run, the quantity of chips corresponded to 4000 grams dry chips.

The results show that a constant liquor/wood ratio is obtained in the chips immersed in the liquor after a pressure treatment of a duration as short as 5 minutes at a reasonable superatmospheric pressure, while treatment at atmospheric pressure does not give a significant increase indigestion liquor content in the chips after a treatment time as lone as 1 hour.

EXAMPLE 2

In a sulphate plant there were used pine chips taken from chips which had been stored on land and chips which had been stored at sea. The land-stored and sea-stored chips were either used individually or in admixture with each other. The dry content of the chips varied from 45 to 55%. The batch digester was fully charged with chips (20 tons of chips calculated on a dry basis) whereby there was obtained a relatively constant quantity of dry wood with each charge, irrespective of the dry weight of the incoming wood. An equal quantity of white liquor and black liquor (1:1) (54 tons) was charged until a liquor/wood ratio of 3.7 was obtained, corresponding to a liquid level in the digester of 2.5 meters above the strainer plates at the beginning of the digestion. The strainer plates were located at a height of 5 meters above the bottom of the digester. In this size digester, 7 tons of liquor corresponds to 1 meter of liquid height.

The charge of liquor was determined on the basis of a normal dry content of the chips of 50% and was found to correspond well to the process conditions applied.

The digestion was started by circulating digestion liquor by means of a circulation pump through a heat exchanger to heat the liquor over approximately 35 minutes to a temperature of 130° C., corresponding to a superatmospheric pressure of 3 bars.

Runs were carried out to illustrate the application of the present invention, in which runs the average moisture content of the chips was determined prior to charging the digester by taking ten samples selected at random. Subsequent to charging the chips to the digester, the black liquor/white liquor was charged thereto in the aforementioned manner, after which the differential pressure between the top of the digester and the strainer plates was found to be 0.25 bar, corresponding to a liquor level of 2.5 meters above the strainer plates. The liquor was then heated to give a temperature of 130° C in the digester and a superatmospheric pressure of 3 bars. The circulation pump was then stopped, and the liquid level measured with a differential pressure gauge. The results of the measurements taken are shown in Table II.

Table II

| Dry Content of the incoming chips % | Liquid level subsequent to heating at 130° C meters | Further Decrease in Liquid Level required to bring level to 0.7 meter above the Strainer plates |
|---|---|---|
| 45 | 1.7 | 1 |
| 50 | 1.1 | 0.4 |
| 55 | 0.7 | 0 |

The results shown that the liquor level above the strainer plates varies according to the moisture (or dry) content of the chips. If the cooking operation is now continued without changing the level of the liquor (by adding or removing liquor) the cook will continue satisfactorily, since in all instances the level of said liquor is located above the strainer plates.

The results show, however, that with chips having a 45% dry content, the amount of black liquor charged could have been reduced by 1 meter or 7 tons, without impairing the digestion. Thus, the energy required to heat the circulating, unnecessarily large quantity of black liquor could have been saved. This saving would have been of the order of magnitude of approximately 10% of the quantity of heat required, which with respect to a sulphate factory of the order of magnitude of 500,000 tons of pulp per year represents a saving of at least 100,000 U.S. dollars per year. The corresponding saving with respect to chips having a dry content of 50% would have been 50,000 U.S. dollars per year.

When applying the method of the invention in the aforedescribed runs the following quantities of liquor were removed in the continued digestion, after which the digestion was completed.

Table III

| Dry content of incoming chips % | Liquor level after removing liquor at 130° C (meters) | The quantity of liquor removed (meters) | The quantity of liquor removed (tons) |
|---|---|---|---|
| 45 | 0.7 | 1 | 7 |
| 50 | 0.7 | 0.4 | 3 |
| 55 | 0.7 | 0 | 0 |

The results were satisfactory, and considerable quantities of heat were saved.

EXAMPLE 3

To the batch digester mentioned in Example 2 there were charged 5 tons of liquor less than in said Example, which corresponded to a liquor level of 1.8 meters prior to heating the liquor. After heating the liquor to 130° C, the liquid level was measured, after which the level was adjusted, either by removing or adding liquor, in accordance with the following:

Table IV

| Dry content of incoming chips (%) | Liquor level after heating to 130° C, (meters) | Liquor level after adjustment (meters) | The quantity of liquor added or removed, (tons) |
|---|---|---|---|
| 45 | 1.2 | 0.7 | −3.5 |
| 50 | 0.6 | 0.7 | +0.7 |
| 55 | 0.2 | 0.7 | +3.5 |

A good digestion was obtained in all cases; at the same time there was a considerable saving in the amount of heat consumed, in comparison with previously known cooking methods.

EXAMPLE 4

This Example illustrates the application of the method according to the present invention in which only a pressure treatment process is applied. To the digester mentioned in Example 2 there were charged 20 tons of chips calculated on a dry basis and 47 tons of digestion liquor, i.e. 7 tons of liquor less than is normal. Accordingly, while in Example 2 the level was 2.5 meters above the strainer plates, 7 tons of liquor corresponding to 1 meter of liquid height in this size of digester, and 7 tons less digestion liquor being used than in Example 2, in this Example 4, the digestion liquor was charged to an initial level of 1.5 meters above the strainer plates. Steam was then directly charged to the top of the digester, with a superatmospheric pressure of 3 bars, this pressure being maintained for 15 minutes. The level of liquor was measured, and adjusted by either removing or adding liquor, in accordance with the following:

Table V

| Dry content of incoming chips (%) | Liquor level after 15 mins of pressure treatment at 3 bars superatmospheric pressure (meters) | Liquor level after adjustment (meters) | The amount of liquor added or removed, (tons) |
|---|---|---|---|
| 45 | 1.1 | 1.1 | 0 |
| 50 | 0.8 | 1.4 | +4.2 |
| 55 | 0.6 | 1.6 | +7.0 |

Since the starting level of the liquor was 1.5 meters in the first run with chips of 45% dry content, the chips had absorbed 0.4 meter of liquor. In the run with chips of 50% dry content, the liquor absorbed was 0.7 meter, and in the run with chips of 55% dry content, the liquor absorbed was 0.9 meter.

In the run with chips of 45% dry content, the liquid level sank to 1.1 meters, meaning that the bottom half of the chip column has absorbed 0.4 meter of liquor, which corresponds to 2.8 tons. The upper half of the chip column, which is not immersed, can be expected to absorb as much, i.e. 0.4 meter, or 2.8 tons. From experience with this digester, it has been determined that a liquid level of 0.7 meter above the strainer plates is sufficient for proper circulation and an efficient digestion. Accordingly, since 1.1 meters −0.4 meter=0.7 meter, is not necessary to add any liquor in this case to maintain a 0.7 meter level.

In the run with chips of 50% dry content, the liquid level sank to 0.8 meter, which means that the bottom half of the chip column has absorbed 0.7 meter, which corresponds to 4.9 tons. The upper half of the chip column, which is not immersed, can be expected to absorb an equal amount, i.e., 0.7 meter or 4.9 tons. Since a liquid level of 0.7 meter is sufficient for proper circulation and an efficient digestion, an addition to the 0.8 meter level of 0.7 meter−0.1 meter or 0.6 meter of liquor, corresponding to 4.2 tons, will be adequate to ensure a liquid level of 0.7 meter. Accordingly, 0.6 meter of liquor was added, after which the liquid level was 1.4 meters.

In the run with chips of 55% dry content, the bottom half of the chip column absorbed 0.9 meter of liquor, which corresponds to 6.3 tons. The upper half of the chip column, which is not immersed, can be expected to absorb as much, i.e., 0.9 meter or 6.3 tons. From experience with this digester, it has been determined that a liquid level of 0.7 meter above the strainer plates is sufficient, and an addition of 0.1 meter to bring the level up to 0.7 meter plus 0.9 meter, corresponding to the liquor absorbed by the upper half of the chip column gives a total of 1 meter or 7 tons of liquor that must be added. Consequently, the liquid level after adjustment is 1.6 meters.

After adjusting the level of liquor, the digestion was started by heating the digestion liquor in the heat exchanger and circulating the liquor in the aforesaid manner. A good digestion result was obtained, and it was possible to save a considerable amount of heat, as compared with conventional cooking methods.

An additional advantage afforded by the method of the present invention is that it is possible, on the basis of the measured level of liquor subsequent to the pressure treatment, to estimate the original average dry content of the lignocellulosic material charged to the digester.

We claim:

1. A process for the batchwise digestion of lignocellulosic material with improved heat economy, using free and absorbed digestion liquor in which the digestion chemicals are in solution in the liquor, comprising charging a batch of digestion liquor and a batch of particulate lignocellulosic material capable of absorbing digestion liquor under pressure to a predetermined level in a batch digester and forming therein a stationary bed of the lignocellulosic material having at least about 50% of the particulate material immersed in digestion liquor; applying a superatmospheric gas pressure in the digester above the level of the digestion liquor within the range from about 1 to about 15 bars above atmospheric pressure until the digestion liquor content of the particulate material has been brought to an equilibrium level at that pressure; determining the level of the digestion liquor after digestion liquor has been absorbed, and then adjusting the level of free digestion liquor in the digester to approximately that level providing an amount including the absorbed liquor sufficient to digest the lignocellulosic material; and then digesting the lignocellulosic material therewith at that pressure to form cellulose pulp.

2. A process according to claim 1, which comprises adjusting the quantity of digestion liquor present in the vessel to the minimum physically required for the digestion.

3. A process according to claim 1 wherein the superatmospheric gas pressure is applied while simultaneously heating the lignocellulosic material at a temperature within the range from about 50° to about 165° C in the presence of the digestion liquor to the digestion temperature.

4. A process according to claim 1 in which the superatmospheric pressure is within the range from about 1.5 to about 8 bars above atmospheric pressure.

5. A process according to claim 1, wherein the superatmospheric pressure is applied while simultaneously heating the lignocellulosic material in the presence of the digestion liquor to the digestion temperature.

6. A process according to claim 1, wherein the superatmospheric pressure is applied over a period of time from about 3 to about 70 minutes.

7. A process according to claim 1 wherein less digestion liquor than is required for the digestion is added prior to the application of superatmospheric pressure, and the remaining quantity of digestion liquor required for the digestion is added subsequent to the application of superatmospheric pressure.

8. A process according to claim 1 in which the particulate lignocellulosic material is wood in the form of chips.

* * * * *